US009765650B2

(12) United States Patent
Cohen

(10) Patent No.: US 9,765,650 B2
(45) Date of Patent: Sep. 19, 2017

(54) PROCESS PRODUCING USEFUL ENERGY FROM THERMAL ENERGY

(71) Applicant: Yoav Cohen, Vessy (CH)

(72) Inventor: Yoav Cohen, Vessy (CH)

( * ) Notice: Subject to any disclaimer, the term of this patent is extended or adjusted under 35 U.S.C. 154(b) by 299 days.

(21) Appl. No.: 14/418,331

(22) PCT Filed: Jul. 23, 2013

(86) PCT No.: PCT/IB2013/056029
§ 371 (c)(1),
(2) Date: Jan. 29, 2015

(87) PCT Pub. No.: WO2014/020486
PCT Pub. Date: Feb. 6, 2014

(65) Prior Publication Data

US 2015/0184547 A1 Jul. 2, 2015

(30) Foreign Application Priority Data

Jul. 30, 2012 (EP) ..... 12178430

(51) Int. Cl.
*F01K 13/00* (2006.01)
*F01K 25/00* (2006.01)

(52) U.S. Cl.
CPC ..... *F01K 13/00* (2013.01); *F01K 25/00* (2013.01)

(58) Field of Classification Search
CPC ..... F01K 13/00; F01K 25/00; H02N 10/00; H02N 1/00; H01L 41/00
See application file for complete search history.

(56) References Cited

U.S. PATENT DOCUMENTS 7,486,000 B1 2/2009 Hacsi
2011/0079012 A1 4/2011 Baik et al.

FOREIGN PATENT DOCUMENTS

DE 102 34 568 A 2/2004
EP 0 369 670 A 5/1990
(Continued)

OTHER PUBLICATIONS

European Search Report and Written Opinion from European Patent Office for priority application EP 12178430 dated Feb. 22, 2013.

*Primary Examiner* — Mark Laurenzi
*Assistant Examiner* — Shafiq Mian
(74) *Attorney, Agent, or Firm* — Haug Partners LLP

(57) ABSTRACT

The invention relates to a process producing useful energy from thermal energy. An overall population of mobile particles confined to a unidirectional flow closed circuit of conducting channels (1-2-3-3'-4-1) is subjected to a conservative or effectively conservative force field. The circuit is thermally insulated with the exception of two non juxtaposed areas a first area (2-3) allowing thermal exchange for heating (Qin) from a warmer environment outside the circuit, a second area (4-1) allowing thermal exchange (Qout) for cooling, as necessary, by a colder environment outside the circuit. The closed circuit is provided with a load (3'-4;) designed to convert the energy it receives from the mobile particles flow to a useful output energy. In two portions of the unidirectional circuit located before (3-3') and after (1-2;) said load, flow velocity vector is parallel or has a component which is parallel to the conservative or effectively conservative force field one portion with a warm flow and the other portion with a cool flow of mobile particles and in that if the density of the chosen mobile particles decreases when the temperature increases, the direction of the conservative force field is the same as that of the cool flow velocity vector or of a cool flow velocity vector component in the (Continued)

said circuit portion and the inverse if the density of the chosen mobile particles increases when the temperature increases.

6 Claims, 6 Drawing Sheets

(56) References Cited

FOREIGN PATENT DOCUMENTS

| | | | |
|---|---|---|---|
| JP | 2011-204960 | A | 10/2011 |
| WO | WO 2010/097260 | A | 9/2010 |
| WO | WO 2010/115654 | A | 10/2010 |

PROCESS PRODUCING USEFUL ENERGY FROM THERMAL ENERGY

This application is a 371 of PCT/IB2013/056029 filed on Jul. 23, 2013, published on Feb. 6, 2014 under publication number WO 2014/020486 A, which claims priority benefits to European Patent Application 12178430.0 filed Jul. 30, 2012, the entire disclosure of which is incorporated herein by reference.

The present invention relates to a process producing useful energy from thermal energy In WO 2010/115654 of the present Patent Application inventor discloses a process and an installation based on principles of action related to the present invention but is limited to a process which is applicable only in a centrifugal force field acting on a fluid which is required to be in state of ideal gas or liquid.

DE 102 34 568 A1 and WO 2010/097260 disclose processes which are based on principles of action that are related to the present invention but are limited to processes which are applicable only in a gravitational force field acting on a fluid which is required to be in state of ideal gas or liquid.

U.S. Pat. No. 7,486,000 B1 disclose a process using the commonly known heat source, heat sink and load. The electric field generates motion of a working substance such as a turning table or ribbon. This mechanical energy is afterwards output for useful work. This motion is generated by manipulating the dielectric constant of the working substance through a heating/cooling cycle. In such modulation of the dielectric constant, the heat added/removed is used to modify the inherent dielectric characteristics of each element in the working substance and so creates two types of matter: one which is strongly interacting with the electric field and the other which is repelled or indifferent to the electric field. This process is defined by the inventor precisely as the "thermo dielectrophoretic effect" used in the claims (pg. 2, line 30).

In opposition to the above, in the herein proposed process the heat does not change the type of each particle and each particle's interaction with the conservative force field (such as electric field) remains identical throughout a full hot/cold cycle. The heating/cooling process modulates the inter-particles' average distance or density and therefore acts by influencing their overall distribution in the steady state process and not their substance.

In addition, in U.S. Pat. No. 7,486,000 B1 process, each element moves in one direction as one type of substance, with a strong force (F) and distance (S) converting its potential energy in the electric field to other mechanical form and on its way back, encounters weak or no counter-force (since it has changed its actual type of substance) over the same distance. That cycle is therefore not a conservative one and the electric field has a net input energy contribution to each cycle, contrary to the herein proposed process.

In the present invention process, each particle, through a full steady state cycle encounters the same force downstream as upstream, over the same distance, and the force field has therefore zero net energy contribution to each full particle cycle making the cycle conservative. The flow through the load, under the influence of the conservative force field, acts to homogenize the particle distribution throughout the closed flow circuits and the heat reestablishes the uneven distribution, maintaining it stable in steady state.

EP 0369670 A2 discloses a process also using the commonly known heat source, heat sink and load. It converts heat differentials to produce useful output electric energy (and vice versa) by harnessing the effects occurring in a junction between two metals or two channel types as related to the seebeck/peltier effects and as referred to in their claims. The process proposed in the present invention does not relate to any junctions nor variations in channel types. In addition that process uses a variable electric field, but for a different purpose and in a different configuration than the herein proposed process. The EP 0369670 A2 process uses the electric field to impose a rapid stop-go current allowing it to improve efficiency by resolving the problem of "cold spot" occurrences by making the current paths random.

The present invention purpose is to improve the above discussed processes by extending the process to additional force field types, materials and material states, physical forms and circumstances of use.

The process of the present invention is defined in claim 1.

What the Process does and how does it Work:

It receives heat and, as necessary, cooling, and it generates useful energy. It acts by subjecting an overall population of mobile particles (also, herein "fluid") forming a closed circuit, to a conservative force field and to selective heating/cooling. This combination of parameters causes the overall particles population in the circuit to have, as a whole, a spontaneous tendency to accelerate along the closed circuit. The energy for this fluid flow and consequent energy output in steady state comes from the input heat rather than from the source generating the force field.

This rotational acceleration tendency along the fluid circuits caused by constantly having, in steady state of the process, two sub-populations of fluid: one denser relative to the other. The conservative force applies a stronger accumulative force on the denser fluid population compared with the accumulative force on the less dense one. This results in an equivalent net force, tangential to the circuit, applied to the overall fluid forcing its flow.

This density differential which exists between the warmer/colder volumes of the circuit, is caused by the fact that the input heat, coupled with output useful energy and heat output as necessary, impose on the overall particles' population to stabilize in steady state, as two distinct separate sub populations of flowing fluid of different average temperatures and densities, appearing as immobile cold area and immobile hot area in the reference frame.

The tendency of the overall fluid mass to accelerate rotationally along the circuit, creates energy density differential on the load's extremities which the load converts to useful output work. The flow of the fluid in steady state has no net energy exchange with the force field since the mass distribution within the force field remains unchanged over time and is therefore balanced in equilibrium only by the net heat flow (input minus output) and work output.

The most important particularity of the process is that heat input is converted directly to increased potential energy, in addition to other forms of energy, which is then together with the other forms, converted to output. In steady state of the system, subjected to the process' parameters, each of the above mentioned fluid sub-populations has a different potential energy relative to the same reference point due to their energetic center of mass heights in the conservative force field. This results in the total fluid present in the system behaving as having an overall rotational potential energy differential manifested as rotational asymmetric inertia for which in steady state there is no related movement in fluid's mass distribution. The fluid as a whole has the tendency to spontaneously accelerate in a circular motion along the flow path which translates to directional force, and consequently, pressure and energy density differential on the load.

The Process Detailed Description Starts Here:

as part of the various known phenomena harnessed by the process, such as the laws of conservation of energy and mass, there are two phenomena which are worth mentioning as background: The first: When particles are in a conservative force field, the field applying a force on them, will cause their acceleration in the direction of the field lines, as per the second law of Newton. This means that in a given reference frame, for which a nonzero conservative force field exists, the particles manifest asymmetric inertial behavior—when these particles are subjected only to the force field represented by its lines, they will spontaneously accelerate in their direction, receiving energy from the field as their center of mass changes position. In such a field each particle has potential energy, whether positive or negative, relative to a reference position. Its movement in the direction of the force converts its negative change in potential energy into work or other form, or combination of forms, of energy and, inversely, its movement against the force reduces the other form/s of energy as it gains potential energy. In such a system, the particle's potential energy change is related to its center of mass's physical position change (path independent) relative to a reference position. The second: Thermal energy, essentially an electromagnetic energy, travels empty space only as electromagnetic waves until it interacts with particles. Once transferred to particles, it is also manifested in them and propagates between them as inter-particle kinetic and potential energy (internal energy) and doing work on their surroundings, occupying volume. The internal energy represents the various internal kinetic and potential energy forms made possible by each type of particle, its environment, and by its inherent degrees of freedom. In charged particles, for example, electric and magnetic fields also play a role in the propagation pattern and particle distribution at equilibrium. This has the consequence of impacting the average distance between the particles and therefore their quantity in a given fixed volume or in other words—their density.

The temperature-density correlation, however, depends on the particles' type and the conditions to which they are subjected. In ideal gas, for example, this relationship exists in a pronounced way—the increased temperature would reduce the gas density, at constant pressure and vice versa. In degenerate gases, such as free electrons in a metal, this relationship still exists but is much less pronounced and depending on the type of metal can even be inverted, higher temperature—more density. In liquids and solids this relationship also exists to a much lesser extent than ideal gas and may even be inverted depending on their particular parameters such as type of particles and temperature.

The process of the present invention will now described using various representations based on the enclosed figures.

PROCESS OPTIONS

Figure 1:
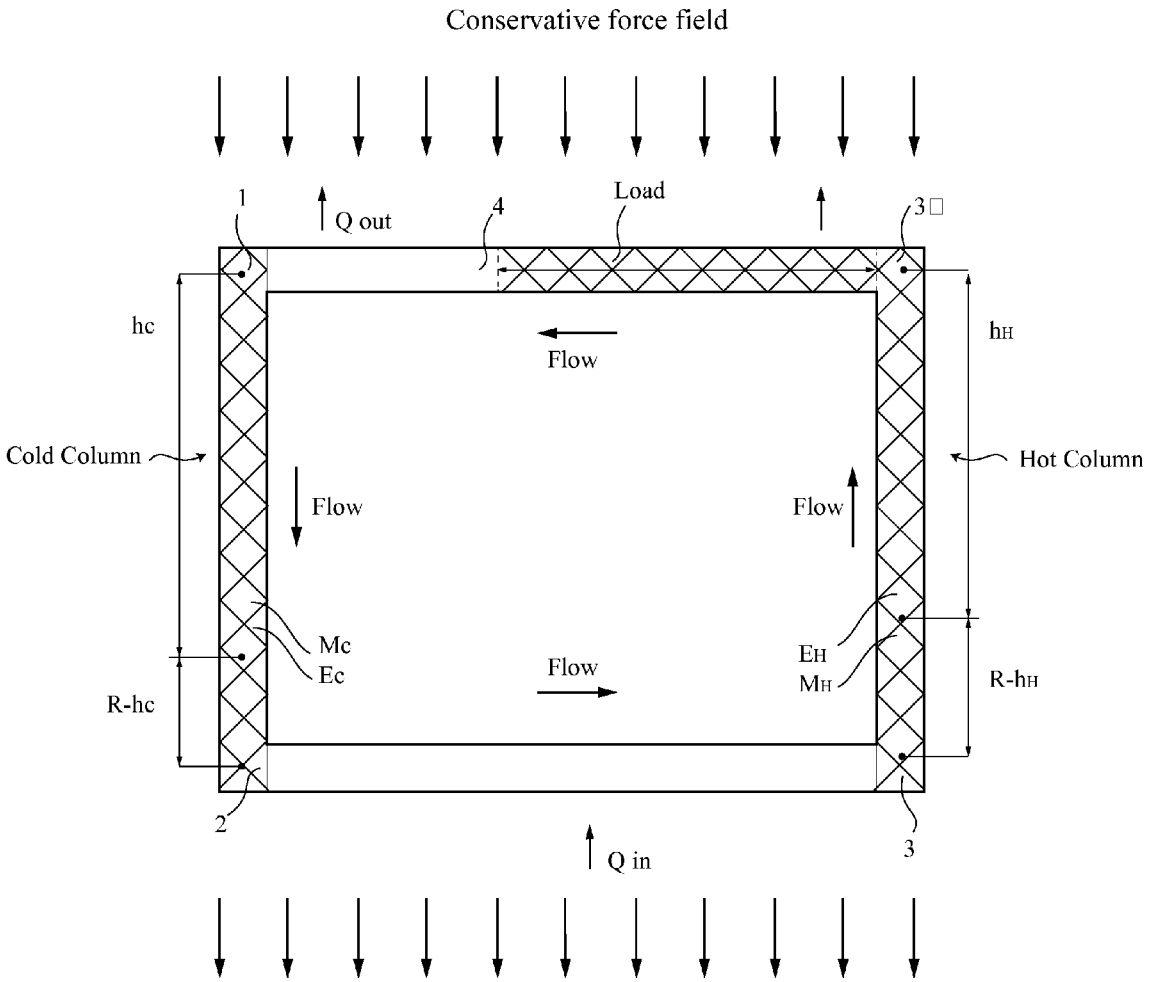
FIG. 1 is a schematic representation of a first embodiment of the process.
Figure 3:
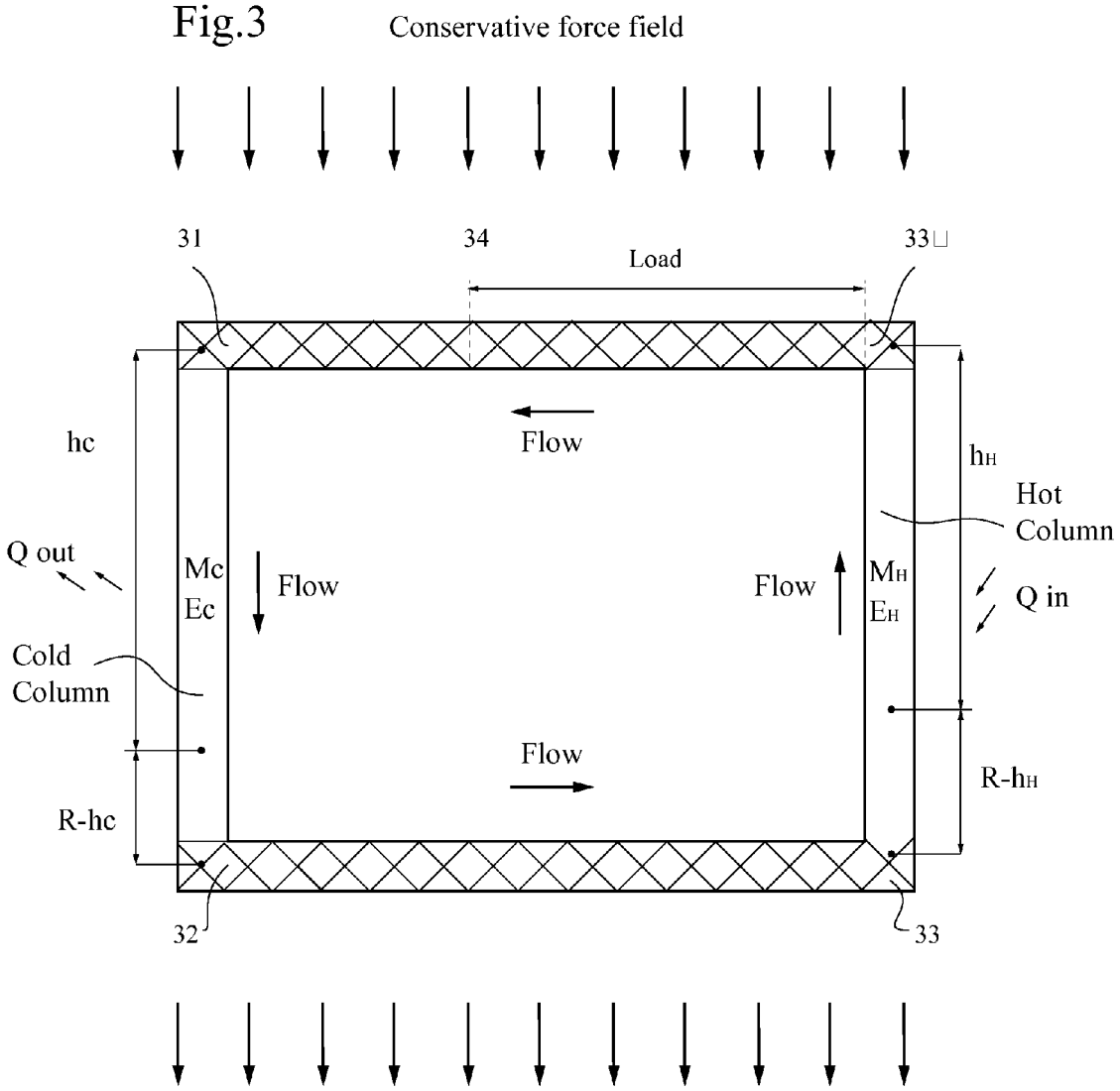
FIG. 3 is another schematic representation of the first embodiment of the process.

The process may be represented in several ways. To provide a sufficiently broad view of the process, It will be herein analyzed in two optional representative configuration examples: one, by which heating is carried out in circuit channel 2-3 and cooling in circuit channel 4-1 and all the rest of the process is thermally isolated (FIG. 1). The other by which heating is carried out in circuit channel 33-33' and cooling in circuit channel 31-32 and the rest of the process is thermally isolated (FIG. 3). The load is represented as positioned in circuit channel 3'-4 or 33'-34. In a practical process the heating configuration may vary, and it may also be based on a combination of these two options.

First Option as Above:

The process, in its generalized basic form, as per FIG. 1, consists of mobile particles confined to a closed circuit 1,2,3,3',4,1 distributed inside or around the outer skin in cases of charged particles, of conducting channels. The system is subjected to a conservative force field as shown. The force lines are parallel to the vertical columns with direction from 1 to 2 and from 3' to 3. The circuit is, for simplicity of the explanation, completely thermally insulated, with the exception of a heat exchange area between stations 2-3 for heating from the warmer environment outside it, and another one at 4-1 for cooling by the colder environment outside it, as necessary. The circuit includes a load at 3'-4, converting the energy it receives from the flow of the particles to useful output energy. The conservative force field may be any kind of conservative field which applies force on all/part of the mobile particles present in the process in the shown direction. This conservative force field may be electrical, magnetic or other. Some of the field types will be de facto conservative only in specific conditions as will be clarified further down. The mobile particles are particles which are free to move in a circuit relative to the process channels 1-2-3-3'-4-1 and may be practically of any type: electrically charged or not, for example, electrons, ions, electrically neutral atoms, molecules etc, and may be in any state such as ideal or degenerate gas, liquid, solid, semi solid (such as a ring/belt), plasma, superconductor. The load in 3'-4 can be any device adapted to the circuit's circumstances, converting the mobile particles' energy into a useful output as, for example, a propeller or piston activating a generator, an electrical resistance (heat output from the system), electric motor etc.

In a steady state process cycle, presented in its most simplified form and analyzed hereinafter, the fluid flows from 1 to 2, subjected to the force field in the same direction as the flow. It loses potential energy as it flows from 1 to 2 and gains in its total combined energy of other forms, regardless of their detailed individual types. With the absence of net energy exchange with the outside through the walls of the channel, flowing adiabatically, the total of the potential energy plus all other forms of a given $m_{(t)}$ mass is a constant at any position along the flow path 1-2. In 2-3, the fluid flows perpendicular to the force field and receives input heat. In 3-3' the heated fluid flows against the force field. It gains potential energy (relative to any given fixed position of reference) as it flows from 3 to 3' and its total combined energy of other forms is reduced, regardless of their detailed individual types. With the absence of net energy exchange with the outside, flowing adiabatically, the total of the potential energy plus all other energy forms of a given $m_{(t)}$ mass is a constant at any position along the flow path 3-3'. In 3'-4 the fluid flows through the load, where its energy is converted to a useful form which is output from the system. In 4-1 the fluid outputs heat, outside of the system, cooling it as required, for the portion of the input heat which was not converted to useful output at 3'-4, to reach station 1 at the energy level required to maintain the steady state. In 3'-1 the fluid flows perpendicular to the force field. In the optimized process, channels 1-2, 3-3' are of the same length along the force field lines. In the process basic form, for simplicity of the representation, consider that on each particle of the fluid an identical, constant, force vector applies (direction and magnitude). Note the process will be analyzed in a rectangular channel structure but can equally be in practice of a circular channel structure, forming a ring, or any other form in a circuit. Another consideration is that fluid density is reduced with increased temperature of the fluid. All channel sections are identical and therefore 1-2, 3-3' are of same volume. These assumptions are not a necessity, but allow for a simplified generalized representation of the process. Channel flow losses and thermal losses are ignored.

In steady state, the channels in the system are filled with flowing/traveling fluid. This thermodynamic analysis of the process is based on the energy and energy distribution of this fluid in the given force field. The energy types involved in this process considering a generic fluid type subjected to a generic conservative force field: every given fluid mass in this process may be represented as having any combination of various types of relevant energy, in varying degrees of detail depending on the type and state of the mobile particles, such as Enthalpy, flow kinetic energy. In addition, in a conservative force field, such a mass has potential energy relative to a reference point. For a fluid mass situated in channel 1-2 for example, between stations 1, and 2, this potential energy is positive relative to station 2 and negative relative to station 1 since the mass has an acceleration vector with direction away from station 1 towards 2. Same for fluid in 3'-3, the fluid mass in it has positive potential energy relative to station 3 and negative relative 3'.

Energy Components

In this analysis, the relevant energy of the fluid or portion of it, being the "system", can be represented by a combination of two components: potential energy relative to a reference point in the surrounding system plus all other relevant types of energy attributable to the system combined, which would be referred to as $E_{Other}$. This energy component $E_{Other}$ may be further detailed as a combination of two components: directional kinetic energy relative to the surrounding system in the chosen reference frame, and all other relevant types of energy attributable to each system, correlating to each fluid mass portion. This latter component is equivalent the total enthalpy of the system, or is the relevant portion of it, which may be further divided into two subcomponents: internal energy, whether internal kinetic, or internal potential, energy being the energy required to create the system, and the amount of energy required to make room for it by displacing the environment establishing its volume and pressure (shall be referred to herein as pressure-volume energy): it can be stated that $E_{other}=H+E_{Kin}=U+PV+E_{Kin}=KPV+E_{Kin}$, H being enthalpy, U being the internal energy, PV the pressure-volume energy, P the pressure or the pressure-volume energy density, V is the volume occupied by the system, $E_{Kin}$ is the kinetic energy of a system, K is the ratio between the enthalpy and the pressure-volume energy. Although K may vary from state of equilibrium to another, and in some systems, significantly, it shall be herein considered as constant for the simplification of the equations as it is approximately so in many circumstances of relatively small variations of system's parameters. This parameter's dynamic behavior shall be incorporated, where it is not negligible, for each practical apparatus using this process, to obtain accurate results.

In steady state of a system containing flowing fluid, the energy, temperature, energy density etc. of a given fluid mass quantity in a given station are constant over time. In other words, the temperature, for example, of the fluid in station 1 will be constant through time. Furthermore, the parameters of the flowing fluid, being constant over time in each station, are interdependent and their relationship is therefore fixed over time. This means that, for example, two randomly picked parameters, the kinetic energy in station 1 and the energy density in station 2, are part of a fixed overall equilibrium. For this reason, the parameters of the fluid in each station in steady state are required to be quantified in the context of, and in consequence of, this overall equilibrium. In view of the above, the chosen approach to analyzing the process incorporates the overall equilibrium as the base for the analysis of the relevant parameters station to station.

In steady state, at any given point in time the total relevant energy of the: Total fluid present in channel 3-3'(also, the "hot column") relative to 1 and to 3', Total fluid in channel 1-2 (also, the "cold column") relative to 1 and to 3', Total fluid present in channel 3-3' relative to 3 and to 2, Total fluid present in channel 1-2 relative to 2 and to 3, may be represented as follows:

$$E_{H1}=E_{H\ other}-E_{PH1}=E_{H\ other}-m_H a h_H \quad (1)$$

$$E_{C1}=E_{C\ other}-E_{PC1}=E_{C\ other}-m_C a h_C \quad (2)$$

$$E_{H2}=E_{H\ other}+E_{PH2}=E_{H\ other}+m_H a(R-h_H) \quad (3)$$

$$E_{C2}=E_{C\ other}+E_{PC2}=E_{C\ other}+m_C a(R-h_C) \quad (4)$$

$$E_{H2}/V=E_{C2}/V \quad (5)$$

which are the energy densities of the overall fluid in 1-2 relative to 2 and the overall fluid in 3-3' relative to 3 (also to 2) are equal as in steady state they retain their parameters stable over time (pressures, temperatures etc.) and there is no load between them in 2-3 which would allow an energy density differential to be sustained. As mentioned earlier losses are ignored.

$$[E_{H\ other}+m_H a(R-h_H)]/V=[E_{C\ other}+m_C a(R-h_C)]/V \quad (6)$$

$$\text{From 6, } E_{C\ other}=E_{H\ other}+\rho_H V a(R-h_H)-\rho_C V a(R-h_C), (m_H=\rho_H V, m_C=\rho_C V) \quad (7)$$

Where, $-E_{PH1}$, $-E_{PC1}$, are the potential energy components, relative to station 1 (or 3') of the total fluid inside 3-3', 1-2 respectively. $E_{PH2}$, $E_{PC2}$, are the potential energy components, relative to station 2 (or 3) of the total fluid inside 3-3', 1-2 respectively. Note: All these values are based on the fluid's energetic center of mass in each column. $E_{H\ 1}$: Total relevant energy of the fluid in the hot column 3-3' relative to station 1 (or 3'). $E_{H\ 2}$: Total relevant energy of the fluid in the hot column 3-3' relative to station 2 (or 3). $E_{H\ other}$: Total energy of the fluid in the hot column 3-3' of all relevant types combined other than potential energy relative to a reference point in the surrounding system. $E_{C1}$ Total relevant energy of the fluid in the cold column 1-2 relative to station 1 (or 3'). $E_{C2}$: Total relevant energy of the fluid in the cold column 1-2 relative to station 2 (or 3). $E_{C\ other}$: Total energy of the fluid in the cold column 1-2 of all relevant types combined other than potential energy relative to a reference point in the surrounding system. a: The acceleration rate of each mass unit of the fluid particles, caused by the conservative force field, in the direction of the force lines (in direction 1 to 2 and 3' to 3). V: Volume of the hot column and also of the cold column. $m_H$: Mass of all the fluid in the hot column 3'-3. $m_C$: Mass of all the fluid in the cold column 1-2. R: The overall length of channel 1-2 and of channel 3-3'. $h_H$: The distance between station 3' and the center of mass ($m_H$) of the fluid inside the hot column (3-3'). $h_C$: The distance between station 1 and the center of mass ($m_C$) of the fluid inside the cold column (1-2). $\rho_H$, is the average density of the fluid in 3'-3 and defined as $m_H/V$. $\rho_C$ is the average density of the fluid in 1-2 and defined as $m_C/V$. $U_H$ is the total internal energy of the whole fluid in the hot column. $u_H$ is the velocity of the fluid in the hot column considered at center of mass. $P_H$ is the pressure or density of the pressure-volume portion in the $E_{Hother}$ energy of the whole fluid in the hot column.

Process input/output: The Energy 3'-1, $E_{3'-1(t)}$ which is work output in 3'-4 and additional cooling by heat output in 4-1, as necessary to maintain steady state over a period of time (t) is quantified as equal to the energy of the fluid received from the hot column over that time less the energy of the fluid of same mass, which exits to the cold column over the same time.

$$E_{3'-1(t)}=E_{H1(t)}-E_{C1(t)} \quad 8$$

Where, $E_{3'-1(t)}$: The total output work received over a period of time (t) by consequence of the fluid flow in 3'-4 in addition to the total heat outflow over the same period of time (t) in 4-1, as necessary to maintain steady state. $E_{H1(t)}$: the energy relative to 3' or to 1, of the warmer fluid of mass $m_{(t)}$ entering into 3'-1 over a period of time (t) from the hot column 3-3'. $E_{C1(t)}$: the energy relative to 1 (or 3') of the colder fluid of same mass, $m_{(t)}$, exiting 3'-1 over the same period of time (t) towards the cold column 1-2

In consequence of energy levels remaining unchanged in each position in the system over time, and, the channels 3-3', 1-2, being thermally insulated from the outside, the ratio between the energy of the fluid entering 3'-1 from the hot column 3'-3 over a period of time (t), $E_{H1(t)}$ and the overall energy of the fluid in the hot column, $E_{H1}$, is equal to the ratio between the mass $m_{(t)}$ passing through it over that time (t) and the overall mass ($m_H$) of the fluid in the hot column 3'-3.

$$(E_{H1(t)}/E_{H1})=(m_{(t)}/m_H) \quad 9$$

And, in the same way: the ratio between the energy of the entering fluid, arriving from 3'-1 into the cold column 1-2 over a period of time (t) $E_{C1(t)}$ and the overall energy of the fluid in the cold column 1-2: $E_{C1}$, is equal to the ratio between the mass $m_{(t)}$ entering the cold column 1-2 over that time (t) and the overall mass of the fluid in the cold column $m_C$. Therefore, $$(E_{C1(t)}/E_{C1})=(m_{(t)}/m_C) \quad 10$$

Combining the above equations:

$$E_{3'-1(t)}=(m_{(t)}/m_H)[E_{H\ other}-m_H a h_H]-(m_{(t)}/m_C)[E_{C\ other}-m_C a h_C] \quad 11$$

$$E_{3'-1(t)}=(m_{(t)}/V)(\rho_H^{-1}E_{H\ other}-\rho_C^{-1}E_{C\ other})-m_{(t)}a(h_H-h_C) \quad 12$$

And therefore when combined with equation 7:

$$E_{3'-1(t)}=(m_{(t)}/V)(\rho_H^{-1}E_{H\ other}-\rho_C^{-1}(E_{H\ other}+\rho_H V a(R-h_H)-\rho_C V a(R-h_C))-m_{(t)}a(h_H-h_C)=m_{(t)}(1-\rho_H/\rho_C)[a(R-h_H)+m_H^{-1}E_{H\ other}]=m_{(t)}(1-\rho_H/\rho_C)[m_H^{-1}E_{H\ other}-ah_H]+m_{(t)}(1-\rho_H/\rho_C)aR \quad 13$$

$E_{H\ other}=U_H+P_H V+E_{HKin}=K_H P_H V+m_H u_H^2/2$ from "energy components",pg. 4 14

$$E_{3'-1(t)}=m_{(t)}(1-\rho_H/\rho_C)[K_H(P_H/\rho_H)+a(R-h_H)+u_H^2/2] \quad 15$$

On the other side, the net thermal energy received over a period of time (t) due to heating, $Q_{2-3(t)}$ in energetic equilibrium:

$$Q_{2-3(t)}=Q_{in(t)}=E_{3'-1(t)}=m_{(t)}(1-\rho_H/\rho_C)[a(R-h_H)+m_H^{-1}E_{H\ other}]=m_{(t)}(1-\rho_H/\rho_C)[m_H^{-1}E_{H\ other}-ah_H]+m_{(t)}(1-\rho_H/\rho_C)aR=m_{(t)}(1-\rho_H/\rho_C)[K_H(P_H/\rho_H)+a(R-h_H)+u_H^2/2] \quad 16$$

As per eq. 15, 16, the energy of the input heat in the system increases its three relevant energetic components: enthalpy, potential energy and directional kinetic energy and the output in 3'-1 decreases them. The proportions of the split depend on the relative magnitude of each component as shown in these equations.

To calculate the useful energy output from the system through the load:

$E_{3'-4(t)}$, $E_{out(t)}$, is the output work from the system over a period of t time, through the load. $E_{3'(t)}$, $E_{4(t)}$ are the total energy values of $m_t$ mass in stations 3' and 4. They both have the same potential energy components, $E_P$, as 3'-4 is perpendicular to the force field. Their energy, as clarified in the "energy components" detailed previously, can be represented as bellow. $U_{3'(t)}$, $U_{4(t)}$, are the internal energies of the fluid $m_t$ in stations 3', 4 respectively. $P_{3'}$, $P_4$ are the pressures in stations 3', 4 respectively. $V_{3'(t)}$, $V_{4(t)}$ are the volumes occupied by $m_t$ in stations 3', 4, respectively. $K_{3'}$, $K_4$, represent the ratios between enthalpy and pressure-volume components of the fluid energy in stations 3', 4 respectively these coefficients are inherent to the type of fluid (and to its particles' degrees of freedom) and its parameters of operation within the process. In many circumstances, such as in ideal gas, liquids etc, for conditions not greatly varying, can be considered constant. $E_{Kin3'}$, $E_{Kin4}$ are the directional kinetic energy components of $m_t$, in the direction of the flow in stations 3', 4 respectively. $\rho_{3'}$, $\rho_4$ are the densities of $m_t$ in stations 3', 4, respectively. The efficiency $\eta$, is defined herein as the ratio between the useful output work to the heat input, for the same period of time, t:

$$(E_{3'-4(t)}/Q_{2-3(t)}).$$

$$E_{3'-4(t)}=E_{out(t)}=E_{3'(t)}-E_{4(t)} \quad 17$$

$$E_{3'(t)}=U_{3'(t)}+P_{3'}V_{3'(t)}+E_{Kin3'}+E_P=K_{3'}P_{3'}V_{3'(t)}+E_{Kin3'}+E_P,(U_{3'(t)}+P_{3'}V_{3'(t)}=K_{3'}P_{3'}V_{3'(t)}) \quad 18$$

$$E_{4(t)}=U_{4(t)}+P_4V_{4(t)}+E_{Kin4}+E_P=K_4P_4V_{4(t)}+E_{Kin4}+E_P,(U_{4(t)}+P_4V_{4(t)}=K_4P_4V_{4(t)}) \quad 19$$

Assuming for simplicity of the representation, $K_{3'}=K_4=K_H=K$, and from conservation of mass:

20. $m_{(t)} = V_{3'(t)}\rho_{3'} = V_{4(t)}\rho_4 = V_{C(t)}\rho_C$ therefore:

21. $$E_{3'-4(t)} = (KP_{3'}V_{3'(t)} + E_{Kin3'} + E_P) - (KP_4V_{4(t)} + E_{Kin4} + E_P) = V_{3'(t)}(KP_{3'} + \rho_{3'}u_{3'}^2/2) - V_{4(t)}(KP_4 + \rho_4 u_4^2/2)$$

On the basis that the energy density differential between an $m_{(t)}$ mass at 3' and $m_{(t)}$ mass at 1 is the same as that imposed by the columns, the following applies:

$$E_{H1}/V-E_{C1}/V=E_{3'(t)}/V_{3'(t)}-E_{1(t)}/V_{1(t)}=E_{3'(t)}/V_{3'(t)}-E_{4(t)}/V_{4(t)} \quad 22$$

(since there is no load on 4-1 and all the parameters of the fluid remain fixed over time in steady state).

Therefore combined with eq. 7:

23. $E_{3'(t)}/V_{3'(t)} - E_{4(t)}/V_{4(t)} = [E_{Hother} - m_H ah_H]/V - [E_{Cother} - m_C ah_C]/V = [E_{Hother} - \rho_H Vah_H - E_{Hother} - \rho_H Va(R - h_H) + \rho_C Va(R - h_C) + \rho_C Vah_C]/V = (\rho_C - \rho_H)aR = (1 - \rho_H/\rho_C)\rho_C aR = (KP_{3'} + \rho_{3'} u_{3'}^2/2) - (KP_4 + \rho_4 u_4^2/2)$ 24. $E_{3'-4(t)} = V_{3'(t)}(KP_{3'} + \rho_{3'} u_{3'}^2/2) - V_{4(t)}(KP_{3'} + \rho_{3'} u_{3'}^2/2 - (1 - \rho_H/\rho_C)\rho_C aR) = (KP_{3'} + \rho_{3'} u_{3'}^2/2)(V_{3'(t)} - V_{4(t)}) + (1 - \rho_H/\rho_C)aR)V_{4(t)} = = m_{(t)}(1 - \rho_{3'}/\rho_4)(KP_{3'}/\rho_{3'} + u_{3'}^2/2) + (\rho_C/\rho_4)m_{(t)}(1 - \rho_H/\rho_C)aR$ 25. $Q_{2-3(t)} = E_{3'-1(t)} = m_{(t)}(1 - \rho_H/\rho_C)(K_H P_H/\rho_H - ah_H + u_H^2/2) + m_{(t)}(1 - \rho_H/\rho_C)aR$ from *eq.*16.

26.

$$\eta = E_{3'-4(t)}/Q_{2-3(t)} = [m_{(t)}(1 - \rho_{3'}/\rho_4)(KP_{3'}/\rho_{3'} + u_{3'}^2/2) + (\rho_C/\rho_4)m_{(t)}(1 - \rho_H/\rho_C)aR]/[m_{(t)}(1 - \rho_H/\rho_C)(KP_H/\rho_H - ah_H + u_H^2/2) + m_{(t)}(1 - \rho_H/\rho_C)aR]$$

$$m_{(t)}(KP_{3'}/\rho_{3'} + u_{3'}^2/2) = m_{(t)}(KP_H/\rho_H - ah_H + u_H^2/2) \quad 27$$

as the energy of $m_{(t)}$ at hot column's center of mass relative to 3' is conserved and is the same as that of $m_{(t)}$ at station 3' relative to 3'. Therefore:

$$\eta = E_{3'-4(t)}/Q_{2-3(t)} = [m_{(t)}(1 - \rho_{3'}/\rho_4)(KP_H/\rho_H - ah_H + u_H^2/2) + (\rho_C/\rho_4)m_{(t)}(1 - \rho_H/\rho_C)aR]/[m_{(t)}(1 - \rho_H/\rho_C)(KP_H/\rho H - ah_H + u_H^2/2) + m_{(t)}(1 - \rho_H/\rho_C)aR] \quad 28$$

In fluid expansion through the load $(1-\rho_3/\rho_4)$ is negative and the first element $(1-\rho_3/\rho_4)(KP_H/\rho_H - ah_H + u_H^2/2)$ is negative. This element is subjected to two counter effects: on one hand expansion making $\rho_4 < \rho_{3'}$, on the other, cooling through the useful output of energy acting to increase density, thus attenuating the density drop between $\rho_{3'}$ and $\rho_4$. With increased overall density of the fluid, the ratio $\rho_{3'}/\rho_4$ gets closer to 1, with tendency in very high density to get close to 1. In addition, this first element becomes smaller by the negative potential energy: $-m_{(t)}\, ah_H$, which is of increased negative value as the field becomes stronger. This means that stronger the conservative field's strength and, higher the density, smaller the first element $m_{(t)}\,(1-\rho_3/\rho_4)(KP_H/\rho_H - ah_H + u_H^2/2)$. In analysis of the dependence of the process efficiency on the various parameters, it can therefore be stated that higher density, combined with higher force field strength, combined with lower enthalpy (and temperature) increases the efficiency. In very high density and force field strength the first element $m_{(t)}\,(1-\rho_{3'}/\rho_4)(KP_H/\rho_H - ah_H + u_H^2/2)$ becomes negligible and the ratio $\rho_C/\rho_4$ close to 1, making the theoretical efficiency approximately:

$$\eta = E_{3'-4(t)}/Q_{2-3(t)} = [m_{(t)}(1 - \rho_H/\rho_C)aR]/[m_{(t)}(1 - \rho_H/\rho_C)[(KP_H/\rho_H - ah_H + u_H^2/2) + (aR)]] \quad 29$$

Defining $KP_H/\rho_H - ah_H + u_H^2/2 = Tot$, Tot gets smaller as the field strength increases (but always remains higher than 0 since otherwise there is no circuit of the fluid). Therefore:

$$\eta = (aR)/(Tot + aR) < 1. \text{ At maximum.} \quad 30$$

Whether in its more complete form (Eq. 28) or in its approximate form (Eq. 30): The efficiency, as defined, in this process results as depending on the proportion between the force field strength and the overall energy of the hot fluid. This is based on the assumption that the energy density differential between the columns relative to 3' and 1 (and 4) is equal to the energy density differential between two masses $m_{(t)}$ in 3' and 1 (and 4).

To analyze the energy exchange between an $m_{(t)}$ mass with the force field in its flow from station 1 (or 4) to station 3', the following is considered:

The fluid, of given mass $m_{(t)}$, in the various stations in channel 1-2 has constant energy relative to 1 (or 3') according to the law of conservation of energy. Same is applicable to the fluid in 3-3':

Total other energy forms (excluding potential energy)+potential energy=Total $$E_1 = (m_{(t)}/m_C)[E_{C\ other} - m_C ah_C] - 0 = (m_{(t)}/m_C)[E_{C\ other} - m_C ah_C] \quad 31$$

$$E_2 = m_{(t)}/m_C)[E_{C\ other} + m_C a(R - h_C)] - m_t aR = (m_{(t)}/m_C)[E_{C\ other} - m_C ah_C] \quad 32$$

$$E_3 = m_{(t)}/m_H)[E_{H\ other} + m_H a(R - h_H)] - m_t aR = (m_{(t)}/m_H)[E_{H\ other} - m_H ah_H] \quad 33$$

$$E_{3'} = (m_{(t)}/m_H)[E_{H\ other} - m_H ah_H] - 0 = (m_{(t)}/m_H)[E_{H\ other} - m_H ah_H] \quad 34$$

It can be seen that from a station to station point of view: the added combined "other energy" (meaning—all forms of energy combined, excluding potential energy relative to a reference point in the system) from station 1 to station 2 is $m_t a$ R being the same as from station 3 to 3'$-m_t a$ R (when considering the specific value, $m_{(t)}$ drops). The flow of a given fluid mass in channels 2-3, 3'-1 does not change its potential energy relative to a reference position since that flow is perpendicular to the force field lines. Each fluid mass, therefore, in every cycle has zero net energy exchange with the conservative force field since it receives $m_t a$ R as it travels from 1 to 2 and returns it from 3 to 3'. Note: Over every given period in time, in steady state, the same mass flows in the direction of the force field lines as that which flows against them, the colder fluid is denser but flows proportionally slower than the warmer one since mass is conserved.

The overall fluid's potential energy by consequence of the conservative force field and density variation between the columns, a fundamental factor in this process, can be quantified as follows: Every mass $m_{(t)}$ anywhere along 1-2 in a random position with its center of mass at distance $h_{C'}$ from station 1, has a combination of energy forms which, all added together, with the exception of the potential energy are referred to as $E_{C\ (t)other}$. In view of its potential energy, however, it has energy relative to station 2 and energy relative to station 1 which is different:

$$E_{C'(t)} = m_{(t)}[E_{C'(t)other} - ah_{C'}] \text{ relative to 1} \quad 35$$

$$E_{C'(t)} = m_{(t)}[E_{C'(t)other} + a(R - h_{C'})] \text{ relative to 2} \quad 36$$

$m_t aR$ is the differential. 37

Same for a mass which is in 3-3', in a random position with its center of mass at distance $h_{H'}$ from station 3'

$$E_{H'(t)} = m_{(t)}[E_{H'(t)other} - ah_{H'}] \text{ relative to 3'} \quad 38$$

$$E_{H'(t)} = m_{(t)}[E_{H'(t)other} + a(R - h_{H'})] \text{ relative to 3} \quad 39$$

$m_{(t)}aR$ is the differential. 40

Note: all the values accompanied by the signs H', C', are the values for that given random station.

This means that this differential does not change station to station anywhere along the flow path from 1 to 2 or from 3 to 3'. However;

The whole fluid in 1-2 is constituted of $m_C/m_t$ units of $m_t$, and The whole fluid in 3-3' is constituted of $m_H/m_t$ units of $m_t$.

Therefore, for the whole fluid in 1-2, the differential between its total energy relative to 2 and its total energy relative to 1 is $m_C$ a R, and for the whole fluid in 3-3' the total energy differential between relative to 3 and relative to 3' is $m_H$ a R.

It is due to the respective position of each mobile particle in the system, in conditions of conservative force field and density differential which is caused by temperature differential.

This represents a potential energy differential between relative to 3' and relative to 1, which is:

$$m_C aR - m_H aR = m_C aR(1 - m_H/m_C) = m_C aR(1 - \rho_H/\rho_C) \quad 41$$

or, represented differently:

$$m_C aR - m_H aR = m_H aR(m_C/m_H - 1) = m_H aR(\rho_C/\rho_H - 1) \quad 42$$

This potential energy is not attributable to a specific particle or mass but rather to the fluid mass as a whole and to the distribution of mass along the circular flow path. For this reason, to represent its value, applicable to an $m_{(t)}$ portion (also incorporating its position and occupied volume), the value changes depending on which $m_{(t)}$ we choose to serve as reference: $m_{(t)}$ which is part of $m_H$ in the hot column, $m_{(t)}$ which is part of $m_C$, in the cold column or one which represents an $m_{(t)}$ portion of the whole fluid mass.

For an $m_{(t)}$ portion of the mass in the context of equation 15, representing the 3'-1 output energy using the hot column fluid energy as reference:

$$m_{(t)} aR(1 - \rho_H/\rho_C) \quad 43$$

by calculating the same representation of $E_{3'-1(t)}$ using the cold column fluid's energy as reference rather than that of the hot column, the result would be:

$$E_{3'-1(t)} = m_{(t)}(\rho_C/\rho_H - 1)[m_C^{-1} E_{Cother} - ah_C] + m_{(t)}(\rho_C/\rho_H - 1)aR,$$

and this potential energy component would be:

$$m_{(t)} aR(\rho_C/\rho_H - 1) \quad 44$$

$m_C$ a R $(1-\rho_H/\rho_C)$ is potential energy attributable to the fluid as a whole, which is stored rotationally along the circular path, 1-2-3-3'-4-1 of the process rather than in the direction of the original conservative field. It is manifested in the tendency of the overall fluid to spontaneously accelerate in a rotational motion or, in other words, it is manifested as rotational asymmetric inertia of the fluid relative to the frame of reference (which in the process is countered by the load to reach steady flow). Because of the position of the load in 3'-4, it is quantified as a potential energy differential between 3' and 1. Through this potential energy, the added heat, makes the fluid in 1-2-3-3' impose a net energy density differential on the fluid in 3'-4. It falls on 3'-4 as energy density differential (and consequently also as pressure differential) because it is there where the load presents a disruption allowing an energy density gradient to persist in steady state and its value is $m_C$ a R/V$-m_H$ a R/V$=(1-\rho_H/\rho_C)\rho_C$ a R. This energy density differential would exist at any position along the process circuit where the load would be placed.

The process environment's thermal energy, which is manifested in matter as symmetric, random micro interparticle collisions, without a specific overall direction, transforms directly through this mechanism to energy which generates a net force (and energy density differential), tangential to the circuit acting in a specific rotational direction. this potential energy of the overall fluid, or of a portion $m_t$ of it, is of magnitude that depends on two elements: a R depending on the strength of the force field, and $(1-\rho_H/\rho_C)$ depending on the hot/cold fluid density ratio and, at its origin, the temperature ratio (multiplied by a coefficient imposed by the process various parameters).

In the output/input energy represented by; $Q_{2-3(t)}/m_{(t)} = E_{3'-1(t)}/m_{(t)} = (1-\rho_H/\rho_C)[m_H^{-1} E_{H\ other} - ah_H] + (1-\rho_H/\rho_C)$ aR, the input heat increases the combined energy of the "other energy forms" plus increases the potential energy of each $m_{(t)}$ passing from the cold to the hot column through 2-3. The output work (and heat outflow, as necessary) decreases the combined energy of the "other energy forms" and decreases the potential energy of each $m_{(t)}$ passing from the hot to the cold column through 3'-1. The strength of the force field impacts the distributed proportions of each input heat unit between the potential energy component and the "other energy forms" component. For a given energy unit input: Stronger the force field, leads to: higher aR (and more negative $-ah_H$), leads to: higher potential energy component portion increase, leads to: smaller "other energy forms" portion increase, higher ratio of useful output to input heat, or efficiency. If we consider flow kinetic energy variations to have a negligible impact on the temperatures distribution in the process, for better understanding of the behavior of the process station to station, it can be stated that because $h_H$ is closer to 3' than $h_C$ is to 1, the temperature differential between that of the whole fluid in 3-3' ($T_H$), at its energetic center of mass, at $h_H$, relative to the temperature of the whole fluid in 1-2 ($T_C$), at its energetic center of mass, $h_C$, is smaller than the temperature rise between 2 to 3. The temperature fall in 3' to 1, in steady state, is equal to the rise in 2-3. The temperature differential between 3-3' is equal to that of 1-2. It is to be noted that in the "other energy forms" component, $(1-\rho_H/\rho_C)$ $[m_H^{-1} E_{H\ other} - ah_H]$ the element $-ah_H$ exists because the value $m_H^{-1} E_{H\ other}$ is this component's value at the center of mass of the warmer fluid in 3-3' and each given $m_{(t)}$ mass portion of this fluid reaches the load at station 3', after it has returned to the system $m_{(t)}ah_H$ of potential energy, this can be seen also in equation 39 quantifying $E_3$.

Second Configuration Option as Per FIG. 3:

This option is identical to the first option in all respects with the exception of the positions of the heating/cooling sources (hot/cold environments) and the thermally insulated/conductive areas. In the analysis of this option losses are also ignored, dimension proportions and force field are as per the first option. The circuit is, for simplicity of the explanation, completely thermally insulated, with the exception of a heat exchange area at station 33-33' for heating and another one at 31-32 for cooling, as necessary. The circuit includes a load at 33'-34 which is now the same as 3'-1 and it is thermally insulated, converting the energy it receives from the flow of the particles to useful output energy. The heating and cooling, as necessary are therefore taking place in the hot/cold columns respectively which has the following consequences: while in the first configuration option the energy of an $m_{(t)}$ mass flowing upwards in 33-33' would have a constant total value anywhere along the flow path with its energy components changing their value relative to each other gradually along the path, but not their total value, in the second option it is not so. In the second configuration option, to this constant total energy value of $m_{(t)}$ is added the input heat from the now thermally non insulated walls. This input heat is added to the $m_{(t)}$ energy level gradually in a way that the total heat added to an $m_{(t)}$ mass from entry at station 33 to exit at station 33', which is also the point of entry into the load, is defined as $Q_{in(t)}$ and to allow for comparison, parallel to $Q_{2\text{-}3(t)}$ from the first option.

The same thing is applicable to the fluid in the cold column: while in the first configuration option the energy of an $m_{(t)}$ mass flowing downwards in 31-32 would have a constant total value anywhere along the flow path with its energy components changing their value relative to each other gradually along the path, but not their total value, in the second option it is not so. In the second configuration option, from this constant total energy value of $m_{(t)}$ is removed the output heat from the now thermally non insulated walls. This output heat is removed from the $m_{(t)}$ energy level gradually in a way that the total heat output from an $m_{(t)}$ mass from entry at station 31, which now is also the point of exit from the load, to exit at station 33', is defined as $Q_{out(t)}$, and to allow for comparison, parallel to $E_{4\text{-}1(t)}$ from the first option. In the second option 32-33 is insulated and perpendicular to the force field and the energy of $m_{(t)}$ in station 32 is equal to its energy in station 33.

In steady state, at any given point in time, even though the energy in each of the columns is variable along the flow path by cause of the heat flow, the total energy values of the whole fluid in the columns are quantifiable: Total fluid present in channel 33-33'(also, the "hot column") relative to 31 and to 33', Total fluid in channel 31-32 (also, the "cold column") relative to 31 and to 33', Total fluid present in channel 33-33' relative to 33 and to 32, Total fluid present in channel 31-32 relative to 32 and to 33, may be represented as follows:

Where: variables $E_{H31}$, $E_{C31}$, $E_{H32}$, $E_{C32}$, $E_{H\ other}$, $E_{C\ other}$, $E_{PH31}$, $E_{PH32}$, $m_H$, $m_C$, R a, V, $P_{33'31}$, $p_{33'34}$, K, $P_H$, $V_{33'(t)}$, $V_{34(t)}$, $E_{Kin33'}$, $E_{Kin34}$, $U_{33'}$, $\rho_{33'}$, $\rho_{34}$, $P_{33'}$, $P_{34}$ have the same meaning as per the first heating configuration. $h_C$ is the distance between station 31 and the center of mass $m_C$, of the fluid in the cold column applicable to quantify its potential energy relative to 31. $h_H$ is the distance between station 33' and the center of mass, $m_H$, of the fluid in the hot column applicable to quantify its potential energy relative to 33'. $E_{H31(t)}$, $E_{C31(t)}$ The average energy values, relative to station 31 (or 33'), of an $m_{(t)}$ mass portion situated in the hot and cold column respectively. $E_{out(t)\ theoretical}$ is the energy differential between the energy of $m_{(t)}$ in 33' to the energy of $m_{(t)}$ in 31, calculated on the basis of the energy equilibrium in the process in steady state and law of conservation of energy applied between 33' and 31. It is also the same as this calculated value for $E_{33'\text{-}31(t)}$, $E_{33'\text{-}34(t)}$. $E_{out(t)real}$ is the energy differential between the energy of $m_{(t)}$ in 33' to the energy of $m_{(t)}$ in 31, calculated on the basis of the energy density drop on the load and law of conservation of energy applied between 33' and 31 for the process in steady state. It is also the same as this calculated value for $E_{33'\text{-}31(t)}$, $E_{33'\text{-}34(t)}$. $Q_{in(t)}$ heat input added to the fluid in 33-33', being the energy differential between that of $m_{(t)}$ in station 33 and that of $m_{(t)}$ in station 33' in steady state. $Q_{out(t)}$ heat output removed from the fluid in 31-32, being the energy differential between that of $m_{(t)}$ in station 31 and that of $m_{(t)}$ in station 32 in steady state. $\rho_C$, $\rho_H$ are average densities of $m_C$, $m_H$, in the cold/hot columns respectively. $\eta$ is the efficiency of the process, being the ratio between the useful output work $E_{out(t)}$ produced over a period of time t, and the heat input over the same time, $Q_{in\ (t)}$.

$$E_{H31}=E_{H\ other}-E_{PH31}=E_{H\ other}-m_H a h_H \quad (45)$$

$$E_{C31}=E_{C\ other}-E_{PC31}=E_{C\ other}-m_C a h_C \quad (46)$$

$$E_{H32}=E_{H\ other}+E_{PH32}=E_{H\ other}+m_H a(R-h_H) \quad (47)$$

$$E_{C32}=E_{C\ other}+E_{PC32}=E_{C\ other}+m_C a(R-h_C) \quad (48)$$

$$E_{H32}/V=E_{C32}/V \quad (49)$$

which are the energy densities of the overall fluid in 31-32 relative to 32 and the overall fluid in 33-33' relative to 33 (also to 32) are equal as there is no load to cause energy density differential.

$$[E_{H\ other}+m_H a(R-h_H)]/V=[E_{C\ other}+m_C a(R-h_C)]/V \quad (50)$$

From above, $E_{C\ other}=E_{H\ other}+\rho_H Va(R-h_H)-\rho_C Va(R-h_C)$, $(m_H=\rho_H V, m_C=\rho_C V)$ (51)

$$E_{H31}/V-E_{C31}/V=E_{3'(t)}/V_{33'(t)}-E_{34(t)}/V_{4(t)}=[E_{H\ other}-m_H a h_H]/V-[E_{C\ other}-m_C a\ h_C]/V=[E_{H\ other}-\rho_H Vah_H-E_{H\ other}-\rho_H Va(R-h_H)+\rho_C Va(R-h_C)+\rho_C Vah_C]/V=(\rho_C-\rho_H)aR=(1-\rho_H/\rho_C)\rho_C aR \quad (52)$$

$$E_{33'\text{-}31(t)}=E_{33'\text{-}34(t)}=E_{33'(t)}-E_{31(t)} \quad (53)$$

$$E_{32\text{-}33(t)}=0; E_{32(t)}=E_{33(t)} \quad (54)$$

The average energy value, relative to station 31 (or 33'), of an $m_{(t)}$ mass portion situated in the hot column:

$$E_{H31(t)}=E_{H31}(m_{(t)}/m_H) \quad (55)$$

The average energy value, relative to station 31 (or 33'), of an $m_{(t)}$ mass portion situated in the cold column:

$$E_{C31(t)}=E_{C1}(m_{(t)}m_C) \quad (56)$$

For the simplicity of the representation, since in/out heat flow pattern along the columns is complex and depends on many variables, the input heat will initially be assumed to be added to $m_{(t)}$ along the flow path 33-33' at a rate that would allow the average energy of $m_{(t)}$ in the column to include $ZQ_{in\ (t)}$. Same for the cold column: The output heat will be assumed to be removed from $m_{(t)}$ along the flow path 31-32 at a rate that would allow the average energy of $m_{(t)}$ in the column to include $-ZQ_{out(t)}$. Z is a positive number smaller than 1 and represents the heat flow pattern to each of the columns: When the majority of heat transfers near fluid's point of entry to the column after entry, Z is higher and vice versa. The heat in/out flow are the consequence of a warmer environment outside, near 33-33' and, as necessary, a colder environment outside, near 31-32.

$$E_{out(t)}=E_{33'\text{-}31(t)}=E_{33'(t)}-E_{31(t)} \quad (57)$$

$$E_{31(t)}-Q_{out(t)}+Q_{in(t)}=E_{33'(t)} \quad (58)$$

Therefore: $E_{out(t)}=Q_{in(t)}-Q_{out(t)}$ (59)

$$E_{H31(t)}=E_{33(t)}+ZQ_{in(t)} \quad (60)$$

$$E_{C31(t)}=E_{31(t)}-ZQ_{out(t)}=E_{32(t)}+(1-Z)Q_{out(t)}=E_{33(t)}+(1-Z)Q_{out(t)} \quad (61)$$

$$E_{H31(t)}-E_{C31(t)}=Z(Q_{in(t)}-Q_{out(t)})+(2Z-1)Q_{out(t)} \quad (62)$$

Therefore, in steady flow:

$$E_{out(t)\ theoretical}=(1/Z)[(E_{H31(t)}-E_{C31(t)})-(2Z-1)Q_{out(t)}]=(1/Z)[(m_{(t)}/V)(\rho_H^{-1}E_{H\ other}-\rho_C^{-1}E_{C\ other})-m_{(t)}a(h_H-h_C-(2Z-1)Q_{out(t)}]=(1/Z)[m_{(t)}(1-\rho_H/\rho_C)[K(P_H/\rho_H)+a(R-h_H)+u_H^2/2]-(2Z-1)Q_{out(t)}] \quad (63)$$

This means that if Z is equal to 1, the result represents the same conditions as per the first configuration option, by which for each process cycle, all the heating of the fluid is done before entering the hot column at station 33 and all the cooling of the fluid is done before entering the cold column at station 31. The first option is therefore, itself, a private case of the second configuration option, and its result would be:

$$Q_{in(t)}-Q_{out(t)}=(1/1)[m_{(t)}(1-\rho_H/\rho_C)[K(P_H/\rho_H)+a(R-h_H)+u_H^2/2]-(2-1)Q_{out(t)}] \quad 64$$

$$Q_{in(t)}=[m_{(t)}(1-\rho_H/\rho_C)[K(P_H/\rho_H)+a(R-h_H)+u_H^2/2] \quad 65$$

Z, of course, can be "tweaked" to be two different variables, one for the heat input and one for the heat output adjusting them separately to optimize practical process performance. To represent, in a simplified manner the efficiency, a Z=0.5, common to both columns, will be hereafter used as an example:

$$E_{out(t)\ theoretical}=2(E_{H31(t)}-E_{C31(t)})=2(m_{(t)}/V)(\rho_H^{-1}E_{H\ other}-\rho_C^{-1}E_{C\ other})-m_{(t)}a(h_H-h_C)=2m_{(t)}(1-\rho_H/\rho_C)[K(P_H/\rho_H)+a(R-h_H)+u_H^2/2] \quad 66$$

This Calculated as per law of conservation of energy and on the basis of energy density drop on the load, practical useful output:

$$E_{out(t)real}=E_{33'(t)}-E_{31(t)}=(KP_{33'}V_{33'(t)}+E_{Kin33'}+E_P)-(KP_{34}V_{34(t)}+E_{Kin34}+E_P)=V_{33'(t)}(KP_{33'}+\rho_{33'}u_{33'}^2/2)-V_{4(t)}(KP_4+\rho_{34}u_{34}^2/2)=V_{33'(t)}(KP_{33'}+\rho_{33'}u_{33'}^2/2)-V_{34(t)}(KP_{33'}+\rho_{33'}u_{33'}^2/2-(1-\rho_H/\rho_C)\rho_C aR)==(KP_{33'}+\rho_{33'}u_{33'}^2/2)(V_{33'(t)}-V_{34(t)})+(1-\rho_H/\rho_C)\rho_C aR)V_{34(t)}=m_{(t)}(1-\rho_{3'}/\rho_4)(KP_{33'}/\rho_{33'}+u_{33'}^2/2)+(\rho_C/\rho_{34})m_{(t)}(1-\rho_H/\rho_C)aR \quad 67$$

$$Q_{in(t)}=E_{out(t)}+Q_{out(t)}=2(E_{H31(t)}-E_{C31(t)})+Q_{out(t)} \quad 68$$

In order to quantify the efficiency in consequence of the practical conditions: $E_{out(t)real}$ is always equal to $E_{out(t)\ theoretical}$ provided there is output heat $Q_{out(t)}$ in 31-32 which is at the necessary level to sustain the steady state of the process. However, for a 100% efficiency theoretical process the following condition applies: $E_{out(t)theoretical}=Q_{in(t)}$ and therefore for that theoretical process, $Q_{out(t)}$ would be equal to zero.

The efficiency can therefore be defined as the ratio between practical useful output energy and input heat $Q_{in(t)}$ in a theoretical perfect efficiency process;

$$\eta=E_{out(t)real}/Q_{in(t)}=\{m_{(t)}(1-\rho_{33'}/\rho_{34})(KP_{33'}/\rho_{33'}+u_{33'}2/2)+(\rho_C/\rho_{34})m_{(t)}(1-\rho_H/\rho_C)aR\}/\{2m_{(t)}(1-\rho_H/\rho_C)[K(P_H/\rho_H)+a(R-h_H)+u_H^2/2]\} \quad 69$$

or, in the approximated version, as per option 1:

$$\eta=aR/\{2(m_H^{-1}E_{H\ other}+a(R-h_H))\}=aR/2(Tot+aR)<½, \text{(when } Z=(½)) \quad 70$$

Summary of Some Main Requirements to Optimally Reproduce the Process in a Practical Apparatus:

The fluid sub-populations in 1-2 and 3-3' respectively 31-32 and 33-33' need to be exposed to equal field strengths. The accumulative force applied by the conservative force field, specific to the apparatus, in the direction 1 to 2 and 3' to 3 respectively 31 to 32 and 33' to 33, varies in correlation with, or, is proportional to, the number of the mobile particles constituting the fluid sub population. Maximal field strength.

The temperature of the fluid impacts its density

1-2, 3-3'; 31-32, 33-33' are equal in length

Adapted load ideally positioned in 3'-4; 33'-34.

Conducting channels allowing for minimal resistance to flow of the mobile particles and allowing the other herein requirements.

No net interaction between mobile particles' flow in steady state and the force field.

Requirements for the Application of the Process to Real and Effectively Conservative Fields:

The process, as a prerequisite subjects the mobile particles to a non-zero conservative field. Some fields, such as constant Electric field and Gravity are straight-forward and are manifested in inertial reference frame. Others, such as centrifugal and, magnetic (as for example variable magnetic field or magnetic field acting on a moving electric charge), require specific conditions to reproduce the conservative nature of their force field, as it pertains to the process, but once these conditions are met, these fields can be considered by the process as effectively conservative.

In such conditions the process can be reproduced as per the principles presented in this paper.

In FIGS. 5 to 8 are presented four examples of the process under four different force fields: subjected to gravitational, centrifugal, described in prior art documents and electric and magnetic fields. In all four examples the process is presented in a relevant reference frame: gravitational and electric in inertial reference frame, centrifugal in rotating reference frame and magnetic in translational reference frame, which in this case is an inertial reference frame with given translational velocity of the channels perpendicular to the magnetic field lines. The choice of reference frame used for the magnetic field is one example out of many options since its effective conservative nature for the process can be reached in translational, rotational or other motion of the system or even in immobile system subjected to an electromagnetic force field, in which the electromagnetic field strength is variable over time, a wave.

The particles in the example circuits 1-2-3-3'-4 are all, each in its appropriate reference frame, subjected to a conservative force field by which each particle changes its potential energy relative to a point in the reference frame as it flows from 1 to 2 and from 3 to 3', and once a full cycle is completed, for example from 1, around the circuit, back to 1, the particles' potential energy is unchanged.

In the two latter examples, in addition to the conservative force elements acting with or against the flow, the fields apply, forces which act to decelerate, or, accelerate, (depending on the fluid flow direction in the channel), the channels' movement perpendicular to the flow. In steady state, by having the same mass moving in one direction as in the other, not changing the mass distribution in the system, over time, these forces cancel out each other completely.

While the conservative forces act on the two populations, on one in their flow direction and on the other, against their flow direction, the strength of these forces depends on their total quantity in each group and therefore depends on their density and for a non-zero density differential between the columns, their total is not zero.

For the forces acting perpendicular to the flow, these counter forces depend on their density but also on their speed and therefore cancel each other out completely this is true in all private cases as it is consequence of the conservation of mass. One group slows the channel velocity and the other accelerates it, having a total effect of zero.

In any circumstances of operation, whether in moving channels or in immobile channels subjected to electromagnetic wave field, same size channels, one containing the cold fluid population and the other containing the hot fluid population, flowing in opposite directions:

The opposite fluid flow, of equal mass per unit of time flowing in each direction between the two sub populations, renders the flow's total energy exchange with the force field (or with its source) to be zero. Once this principle is established, in the chosen reference frame, these fields can be analyzed as directional, conservative force fields acting on the mobile particles with the circuit being 1-2-3-3'-4-1, performance optimized by equal length 1-2, 3-3' channels. To be noted that these forces, perpendicular to the flow do have an effect on the particles distribution along the channels' cross section, a factor that may influence the effective cross channel section area, A, and may affect channel losses. Once taken into account, however this effect can be rendered negligible and in any event, it does not change the counter force mutual cancellation and does not change the zero net energy exchange between the fluid flow and the field, in steady state. The type of conservative force applicable to each circuit replacing the generic F=ma used in this paper depends on the type of force field/particles in each specific case as for example F=qE+qBu, $F=m\Omega^2 r$, F=mg.

The efficiency in both configuration options may be analyzed from the point of view of the overall fluid's rotational acceleration characteristic in the force field resulting in certain conditions in unstable behavior:

For first configuration option: (FIG. 1): The whole fluid manifests asymmetric rotational inertial behavior relative to the reference frame and has therefore a tendency to accelerate in a rotational motion, along the circuit. This means that to have steady state, the load needs to present a counter force, equal to the one accelerating it and therefore a pressure differential, independently from effects of variation in directional kinetic energy, since in steady state the station to station kinetic energy variations have neither accelerating nor decelerating effect, on the fluid in the circuit 1-2-3-3'-4 as a whole. which is identical to the pressure differential imposed by the columns. This would make the calculation of the efficiency behave as follows:

The energy density differential $E_{H1}/V-E_{C1}/V$ is equal to $(1-\rho_H/\rho_C)\rho_C$ a R. in the process's circumstances It is also pure pressure differential, as it is the result of a static force on the fluid's sub populations caused by the conservative force field:

$$\Delta F_{3'1}=\Delta F_{3'4}=m_C a-m_H a=m_C(1-\rho_H/\rho_C)a=\rho_C V(1-\rho_H/\rho_C)a \quad 71$$

$$\Delta P_{3'1}=\Delta P_{3'4}=(m_C a-m_H a)/A=(m_C(1-\rho_H/\rho_C)a)/A=(\rho_C V(1-\rho_H/\rho_C)a)/A=(1-\rho_H/\rho_C)\rho_C aR \quad 72$$

This force and consequent pressure differential is the force/pressure differential required to zero the overall rotational acceleration tendency, of the whole fluid population. It is a requirement of the steady state being of steady flow velocity. The variations of the directional kinetic energy from station to station in steady state do not influence this force differential as the flow of the fluid as a whole does not change any of its parameters over time and therefore does not interact with this force, which, viewed in the process's reference frame is static and tangential to the flow circuit, acting on the fluid as a whole by consequence of the conservative force field.

The fluid situated in 3', of mass $m_{(t)}$ is at pressure which is the consequence of the interaction between the fluid band 4-1-2-3-3' (which is of tendency to accelerate towards 3') and the load.

The fluid in 4 of same mass $m_{(t)}$, is at pressure which is the consequence of the interaction between the same fluid band 4-1-2-3-3'(which is of tendency to accelerate away from 4) and the load. The pressure differential between these two stations is $(1-\rho_H/\rho_C)\rho_C$ a R regardless of the variations in temperatures, volumes or velocities of the specific $m_{(t)}$ masses situated in 3' and 4 in steady state but depends rather on the process's overall equilibrium.

Therefore: the efficiency, as per this requirement would behave as:

$$\eta'=E_{3'\text{-}4(t)}/Q_{2\text{-}3(t)}=[(KP_{3'}V_{3'(t)}+E_{Kin3'}+E_P)-(KP_4V_{4(t)}+E_{Kin4}+E_P)]/Q_{2\text{-}3(t)}=[V_{3'(t)}(KP_{3'}+{}_{3'}u_{3'}^2/2)-V_{4(t)}(KP_4+{}_4u_4^2/2)]/Q_{2\text{-}3(t)}[V_{3'(t)}(KP_{3'}+{}_{3'}u_{3'}^2/2)-V_{4(t)}(K(P_{3'}-(1-\rho_H/\rho_C)\rho_C aR)+{}_4u_4^2/2)]/Q_{2\text{-}3(t)}=[KP_{3'}(V_{3'(t)}-V_{4(t)})+(\rho_C/\rho_4)Km_{(t)}(1-\rho_H/\rho_C)aR+m_{(t)}u_{3'}^2/2-m_{(t)}u_4^2/2]/Q_{2\text{-}3(t)}\text{Therefore:} \quad 73$$

$$\eta'=[m_{(t)}(1-\rho_{3'}/\rho_4)(KP_{3'}/\rho_{3'})+m_{(t)}(1-\rho_{3'}^2/\rho_4^2)(u_{3'}^{2/2})+(\rho_C/\rho_4)Km_{(t)}(1-\rho_H/\rho_C)a\ R]/[m_{(t)}(1-\rho_H/\rho_C)(KP_H/\rho_H-ah_H+u_H^2/2)+m_{(t)}(1-\rho_H/\rho_C)aR] \quad 74$$

In its approximate form, on the basis of high pressure and density, strong force field, $m_{(t)}(1-\rho_{3'}/\rho_4)(KP_{3'}/\rho_{3'})+m_{(t)}(1-\rho_{3'}^2/\rho_4^2)(u_{3'}^2/2)$ gets smaller and if, on basis of these criteria, considered negligible, $\rho_C/\rho_4$ considered close to 1, the approximate form of the η' becomes:

$$\eta'=[KaR]/[Tot+aR] \quad 75$$

in such an event in conditions of strong enough force field, the state will be stable up to a given threshold level by which η'=1. Passed this level the state will not be stable and excess required energy necessary to reach the appearance of η'>1 would be taken from the field, for the unstable transition and from the fluid causing the progressive cooling of the system until efficiency drops (real efficiency is not exceeding parity. In the non steady state transition, in the energy input are participating the external field and the fluid's energy previous to additional heat input) to regaining steady state. This would mean an effective one source system with no additional cooling required from an external colder environment and/or without requiring a portion of the useful output energy to be used for additional cooling of the system as may be required by the analysis of n. Such one source result would be in contravention of the second law of Thermodynamics.

For the second configuration option (FIG. 3), as per the Z=0.5 example, this becomes:

$$\eta'=[KaR]/2[Tot+aR] \quad 76$$

The process in conditions by which the mobile particles' temperature-density is inversed, when increasing fluid's temperature increases its density: in such conditions, the process works as per the same principles, provided direction of the force field is inverted. An important consequence would be that in these circumstances, on the load, the expansion effect by reason of loss of pressure, acts in the same way as the temperature drop due to the output of energy through 3'-4 or 33'-34: they both act to reduce the density.

A portion of the useful output energy at 4 or 24 or 34 or 44 may be fed back to cool the mobile particles as necessary to maintain steady state.

Figure 2:
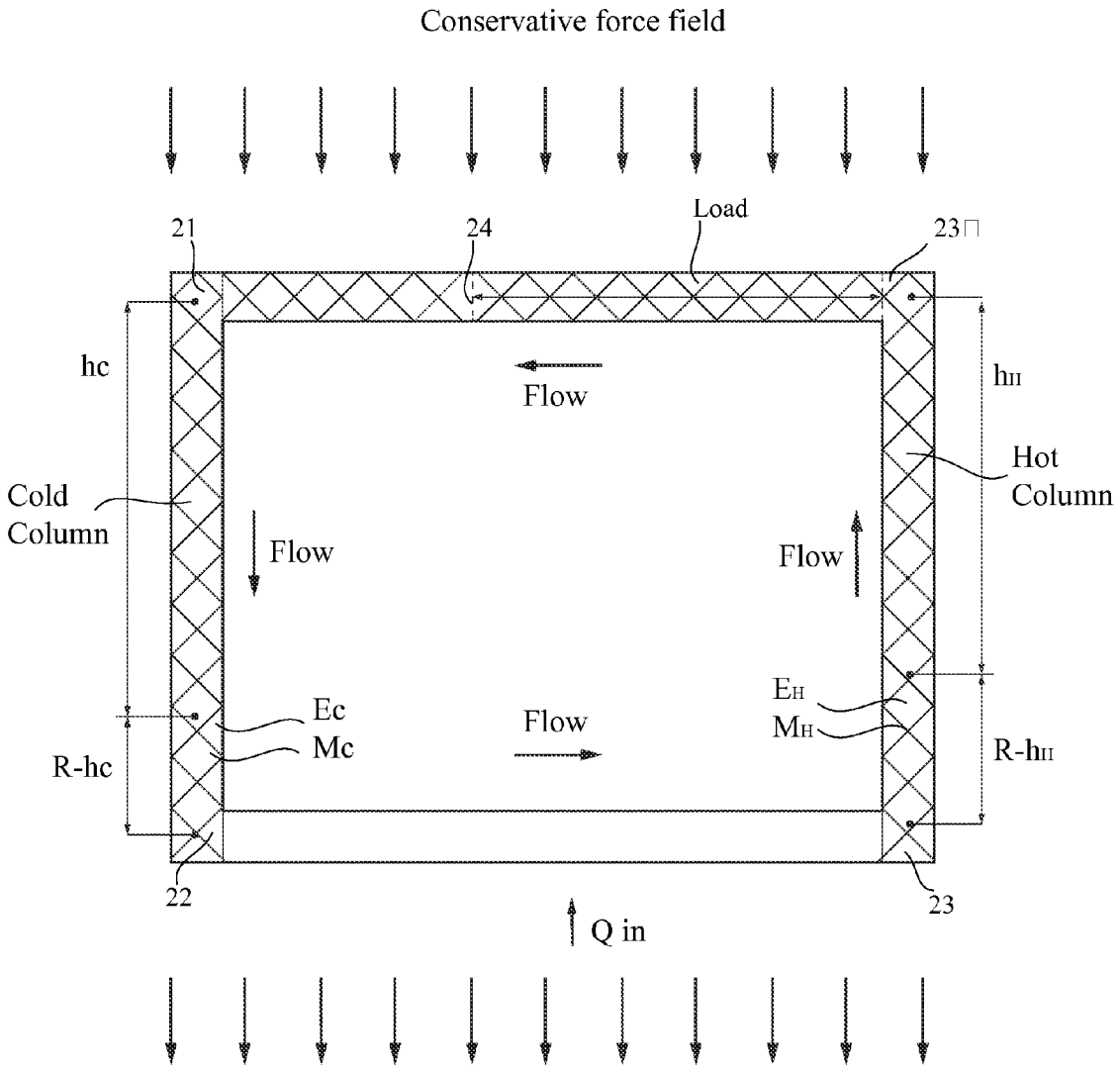
FIG. 2 is a schematic representation of a second embodiment of the process.
Figure 4:
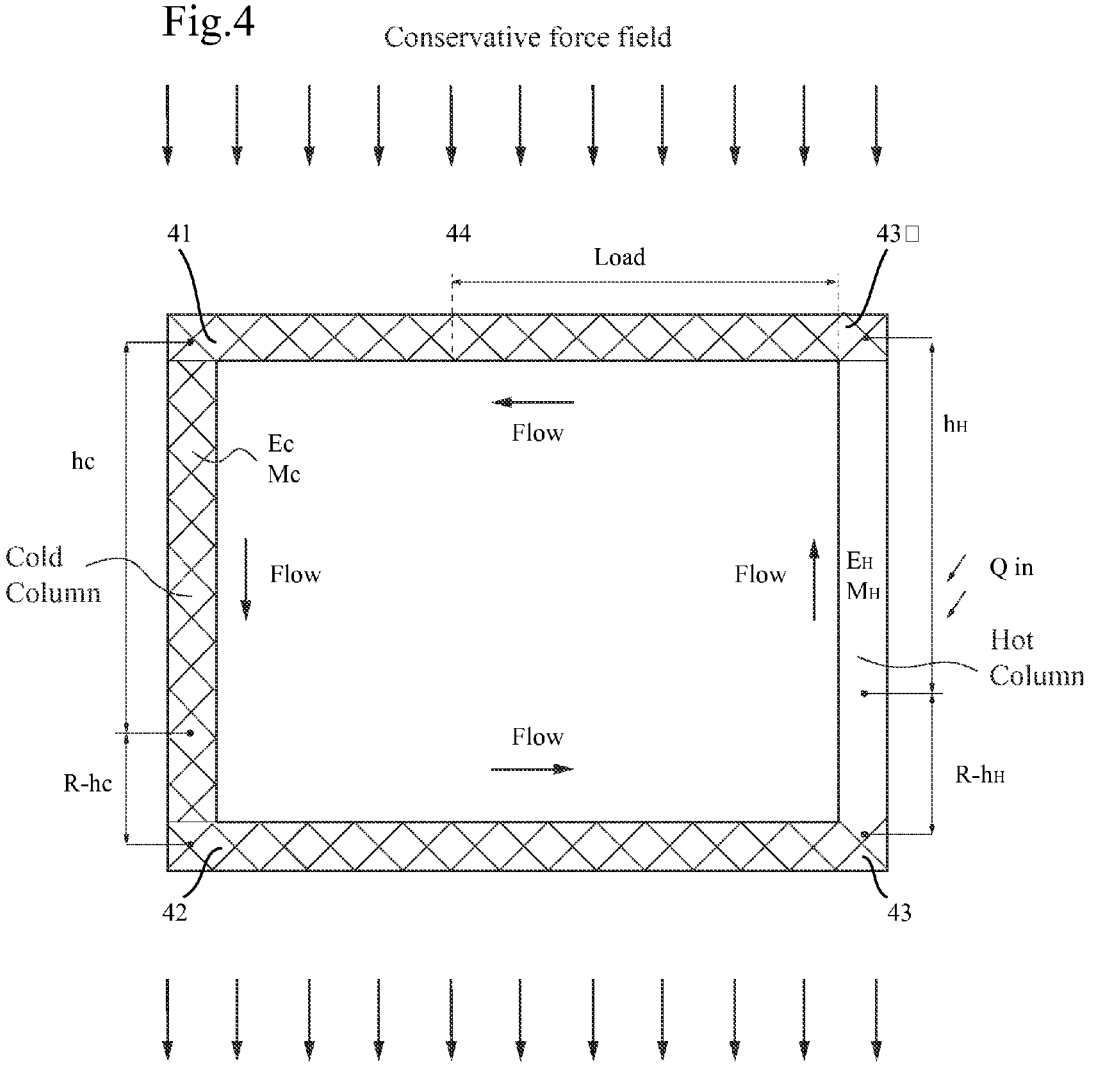
FIG. 4 is another schematic representation of the second embodiment of the process.
Figure 5:
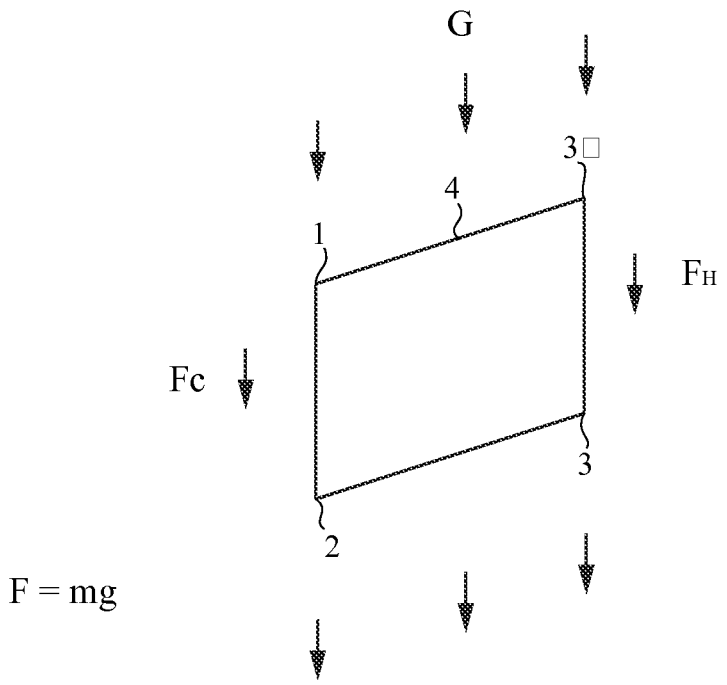
FIGS. 5 to 8 are schematic representations of the process the conservative force field being respectively, electric, magnetic, according to the present invention and gravitational and centrifugal according to the prior art
Figure 6:
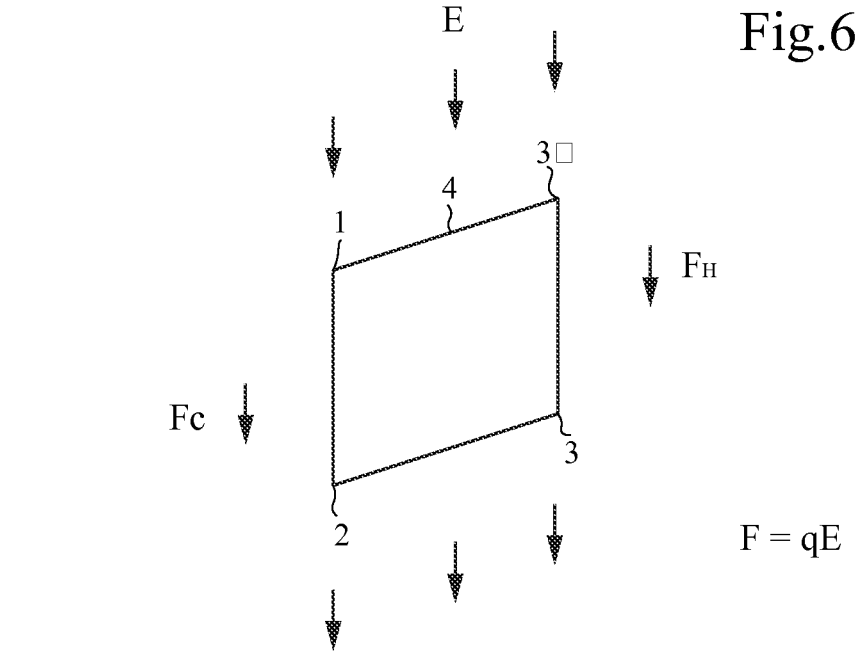
Figure 7:
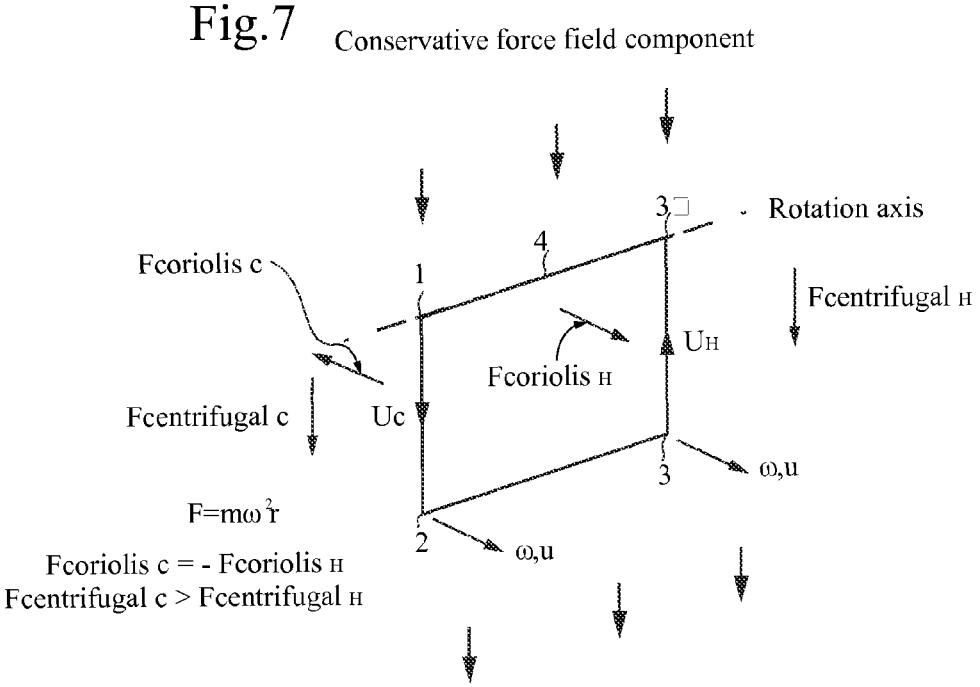
Figure 8:
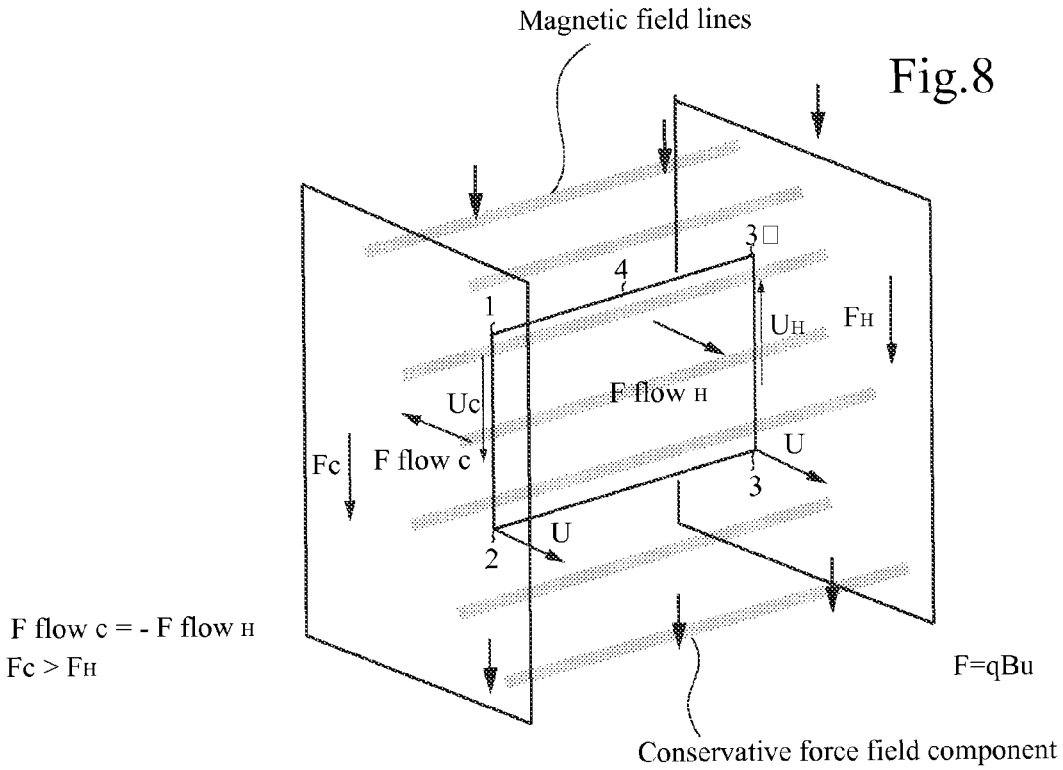

In case the cooling of the flow during its passage through the Load at 23'-24 or 43'-44 (FIGS. 2, 4) is sufficient it is not necessary to cool further the flow after the station 24 or 34 and in this case the section 24-21 or 41-42 are also isolated as no heating exchange for cooling by a colder environment outside the circuit is necessary.

The invention claimed is:

1. A process of producing useful energy from thermal energy, comprising:

subjecting a fluidic overall population of mobile particles confined to an unidirectional flow closed circuit of conducting channels to a conservative or effectively conservative force field, the conservative or effectively conservative force field being an electric or magnetic force field, the unidirectional flow closed circuit being thermally insulated with exception of two non-juxtaposed areas, the two non-juxtaposed areas comprising:

a first non-thermally insulated non-juxtaposed area allowing thermal exchange for heating from a warmer environment outside the unidirectional flow closed circuit, and a second non-thermally insulated non-juxtaposed area allowing thermal exchange for cooling by a colder environment outside the unidirectional flow closed circuit, and converting the thermal energy from a flow of the mobile particles to a useful output energy by means of a load, wherein the load is located in a flow direction after the first non-thermally insulated non-juxtaposed area; and between two portions of the unidirectional closed circuit in which a fluid flow or a component of the fluid flow is parallel to the conservative or effectively conservative force field, wherein the two portions of the unidirectional closed circuit comprises:

a first portion with a warm flow and a second portion with a cool flow of the mobile particles, wherein the mobile particles are selected so that their density decreases or increases when the temperature increases, and wherein the direction of the conservative or effectively conservative force field and direction of the cool flow or of a cool flow component in the second portion is same when the mobile particles are selected so that their density decreases when temperature increases, and the direction of the conservative force or effectively conservative field is inverse when the mobile particles are selected such that their density increases when the temperature increases.

2. The process according to claim 1, wherein a length of each of the said two two non-thermally insulated non-juxtaposed areas varies.

3. The process according to claim 1, wherein a portion of the useful output energy is fed back to cool the mobile particles to maintain steady state.

4. The process according to claim 1, wherein the mobile particles are particles which are free to move in the conducting channels and may be of any type: electrically charged or not as electrons, ions, electrically neutral atoms, molecules, and may be in any state such as ideal or degenerate gas, liquid, solid, semi solid plasma, superconductor.

5. The process according to claim 2, wherein the mobile particles are particles which are free to move in the conducting channels and may be of any type: electrically charged or not as electrons, ions, electrically neutral atoms, molecules, and may be in any state such as ideal or degenerate gas, liquid, solid, semi-solid plasma, superconductor.

6. The process according to claim 3, wherein the mobile particles are particles which are free to move in the conducting channels and may be of any type: electrically charged or not as electrons, ions, electrically neutral atoms, molecules, and may be in any state such as ideal or degenerate gas, liquid, solid, semi-solid plasma, superconductor.

* * * * *